US010217596B2

(12) United States Patent
Liang et al.

(10) Patent No.: US 10,217,596 B2
(45) Date of Patent: Feb. 26, 2019

(54) HIGH TEMPERATURE ANNEALING IN X-RAY SOURCE FABRICATION

(71) Applicant: General Electric Company, Schenectady, NY (US)

(72) Inventors: Yong Liang, Niskayuna, NY (US); Vance Scott Robinson, Glenville, NY (US)

(73) Assignee: General Electric Company, Schenectady, NY (US)

( * ) Notice: Subject to any disclaimer, the term of this patent is extended or adjusted under 35 U.S.C. 154(b) by 215 days.

(21) Appl. No.: 15/280,701

(22) Filed: Sep. 29, 2016

(65) Prior Publication Data

US 2018/0090293 A1 Mar. 29, 2018

(51) Int. Cl.
*H01J 35/08* (2006.01)

(52) U.S. Cl.
CPC ..... *H01J 35/08* (2013.01); *H01J 2235/084* (2013.01); *H01J 2235/088* (2013.01); *H01J 2235/1291* (2013.01)

(58) Field of Classification Search
CPC ..... H01J 35/12; H01J 35/06; H01J 35/105; H01J 2235/088; H01J 2235/085; H01J 35/08; H01J 35/18; H01J 2235/084; H01J 2235/1291
USPC ..... 378/119–144
See application file for complete search history.

(56) References Cited

U.S. PATENT DOCUMENTS

| | | | | |
|---|---|---|---|---|
| 5,352,489 | A | 10/1994 | Ohara et al. | |
| 6,274,484 | B1 | 8/2001 | Tsai et al. | |
| 7,359,487 | B1 * | 4/2008 | Newcome | H01J 35/08 378/119 |
| 9,008,278 | B2 | 4/2015 | Lee et al. | |
| 2014/0205071 | A1 | 7/2014 | Ikarashi et al. | |
| 2014/0290145 | A1 | 10/2014 | Zhuk et al. | |

OTHER PUBLICATIONS

Bruel, Michael, et al.; "Smart-Cut: A New Silicon on Insulator Material Technology Based on Hydrogen Implantation and Wafer Bonding" Japanese Journal of Applied Physics, vol. 36, Part: 1, No. 3B, 1997.
Reichart, P., et al.; "Three-dimensional hydrogen microscopy in diamond", Science, 306(5701):1537-40, Nov. 26, 2004.
Langer, B., et al.; "Recent Achievements in SopSiC substrates for High Power and High Frequency Applications", CS MANTECH Conference, pp. 71-72, Apr. 24-27, 2006.
Hoen, M.H.J., et al.; "Surface morphology and deuterium retention of tungsten after low- and high-flux deuterium plasma exposure", Nuclear Fusion, vol. 54, No. 8, Jun. 11, 2014.

* cited by examiner

*Primary Examiner* — Courtney D Thomas
(74) *Attorney, Agent, or Firm* — Mintz Levin Cohn Ferris Glovsky and Popeo, P.C.

(57) ABSTRACT

The present disclosure relates to multi-layer X-ray sources having decreased hydrogen within the layer stack and/or tungsten carbide inter-layers between the primary layers of X-ray generating and thermally-conductive materials. The resulting multi-layer target structures allow increased X-ray production, which may facilitate faster scan times for inspection or examination procedures.

20 Claims, 6 Drawing Sheets

HIGH TEMPERATURE ANNEALING IN X-RAY SOURCE FABRICATION

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A variety of medical diagnostic, laboratory, security screening, and industrial quality control imaging systems, along with certain other types of systems (e.g., radiation-based treatment systems), utilize X-ray tubes as a source of radiation during operation. Typically, the X-ray tube includes a cathode and an anode. An electron beam emitter within the cathode emits a stream of electrons toward an anode that includes a target that is impacted by the electrons.

A large portion of the energy deposited into the target by the electron beam produces heat within the target, with another portion of the energy resulting in the production of X-ray radiation. Indeed, only about 1% of the energy from the electron beam X-ray target interaction is responsible for X-ray generation, with the remaining 99% resulting in heating of the target. The X-ray flux is, therefore, highly dependent upon the amount of energy that can be deposited into the source target by the electron beam within a given period of time. However, the relatively large amount of heat produced during operation, if not mitigated, can damage the X-ray source (e.g., melt the target). Accordingly, conventional X-ray sources are typically cooled by either rotating or actively cooling the target. However, when rotation is the means of avoiding overheating, the amount of deposited heat along with the associated X-ray flux is limited by the rotation speed (RPM), target heat storage capacity, radiation and conduction cooling capability, and the thermal limit of the supporting bearings. Tubes with rotating targets also tend to be larger and heavier than stationary target tubes. When the target is actively cooled, such cooling generally occurs relatively far from the electron beam impact area, which in turn significantly limits the electron beam power that can be applied to the target. In both situations, the restricted heat removal ability of the cooling methods markedly lowers the overall flux of X-rays that are generated by the X-ray tube.

With this in mind, certain approaches may employ a layered X-ray source configuration, where layers of X-ray generating material are interleaved with layers of heat-conductive material to facilitate heat dissipation. One example may be a multi-layer diamond tungsten structure, where the tungsten generates X-rays when impacted by an electron beam and the diamond conducts heat away. Such a multilayer tungsten-diamond target structure is capable of producing high X-ray flux density due suitable heat dissipation, and is consequently able to withstand higher electron-beam irradiation than a conventional target structure. However, such a multi-layer structure may suffer from delamination of the layers in an operational setting. For example, adhesion between the X-ray generating and heat conducting layers may be inadequate during operation due to insufficient interfacial chemical bonding between layers.

BRIEF DESCRIPTION

Certain embodiments commensurate in scope with the originally claimed subject matter are summarized below.

These embodiments are not intended to limit the scope of the claimed subject matter, but rather these embodiments are intended only to provide a brief summary of possible embodiments. Indeed, the invention may encompass a variety of forms that may be similar to or different from the embodiments set forth below.

In a first embodiment, an X-ray source is provided. In accordance with this embodiment, the X-ray source includes: an emitter configured to emit an electron beam, and a target configured to generate X-rays when impacted by the electron beam. The target includes: at least one X-ray generating layer comprising X-ray generating material, wherein planar density hydrogen held within some or all of the X-ray generating layers is less than $5\times10^{16}/cm^2$; and at least one thermally-conductive layer in thermal communication with each X-ray generating layer, wherein each thermally conductive layer or substrate comprises grain boundaries in which hydrogen is held, and wherein the planar density hydrogen held within some or all of the thermally conductive layers is less than $5\times10^{16}/cm^2$.

In a further embodiment, an X-ray source is provided. In accordance with this embodiment, the X-ray source includes: an emitter configured to emit an electron beam, and a target configured to generate X-rays when impacted by the electron beam. The target includes: at least one X-ray generating layer comprising X-ray generating material; at least one thermally-conductive layer in thermal communication with each X-ray generating layer; and a carbide layer positioned between each X-ray generating layer and adjacent thermally-conductive layer.

In an additional embodiment, method is provided for fabricating an X-ray source target. In accordance with this method, an X-ray generating material and a thermally-conductive material are deposited, in alternation, on a thermally-conductive substrate to form a multi-layer target structure of alternative X-ray generating layers and thermally-conductive layers. An annealing operation is performed on the multi-layer target structure. The annealing operation results in carbide layers formed between each layer of X-ray generating material and thermally-conductive material.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
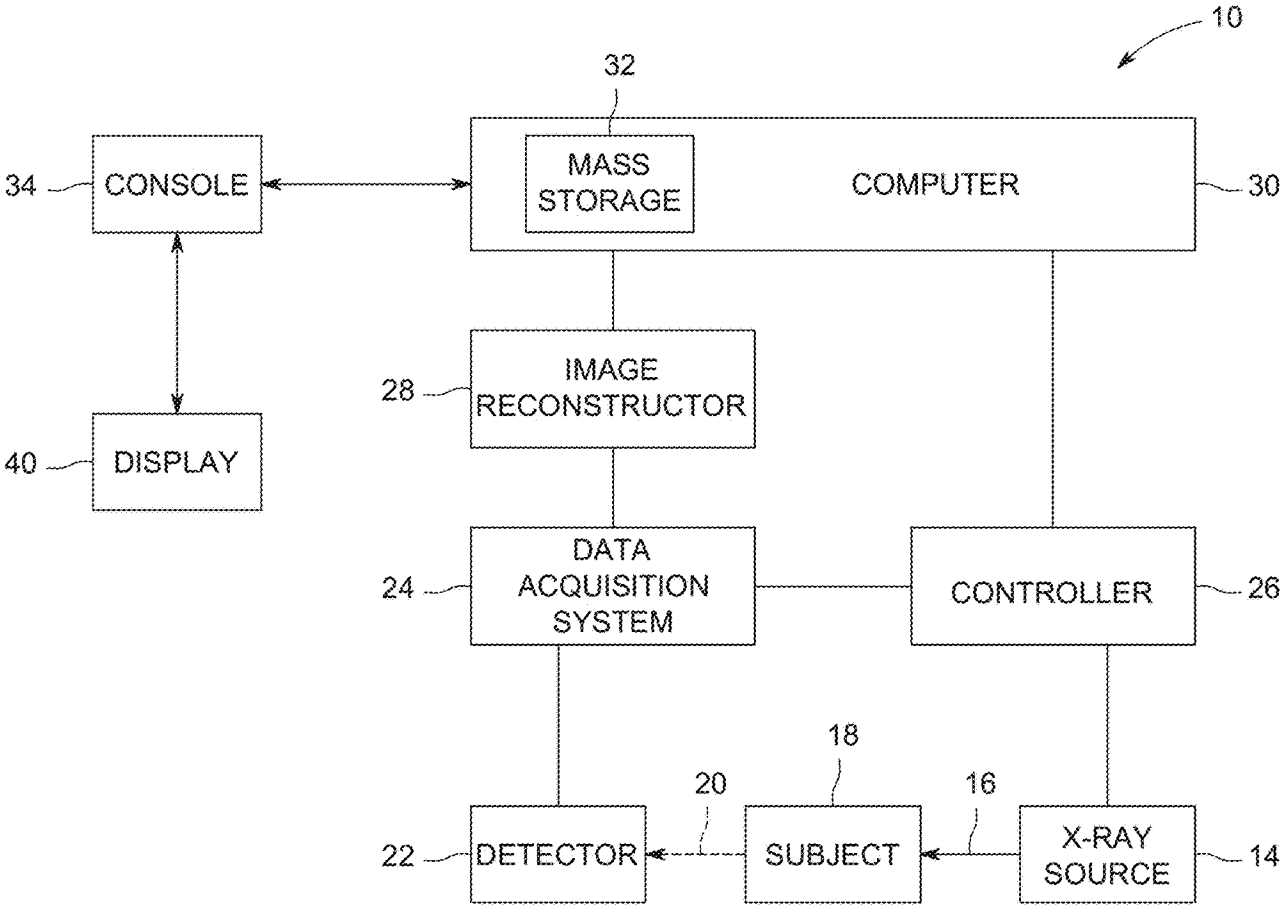
FIG. 1 is a block diagram of an X-ray imaging system, in accordance with aspects of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As noted above, the X-ray flux produced by an X-ray source may depend on the energy and intensity of an electron beam incident on the source's target region. The energy deposited into the target produces, in addition to the X-ray flux, a large amount of heat. Accordingly, during the normal course of operation, a source target is capable of reaching temperatures that, if not tempered, can damage the target. The temperature rise, to some extent, can be managed by convectively cooling, also referred to as "direct cooling", the target. However, such cooling is macroscopic and does not occur immediately adjacent to the electron beam impact area where damage i.e. melting, can occur. Without microscopic localized cooling, the overall flux of X-rays produced by the source is limited, potentially making the source unsuitable for certain applications, such as those requiring high X-ray flux densities. Rotating the target such that the electron beam distributes the energy over a larger area can reduce the target temperature locally but it typically requires larger evacuated volumes and the additional complexity of rotating components such as bearings. Further, vibrations associated with rotating targets become prohibitive for high resolution applications where the required spot size is on the order of the amplitude of the vibration. Accordingly, it may be desirable if the source could be operated in a substantially continuous basis in a manner that enables the output of high X-ray flux.

One approach for addressing thermal build-up is to use a layered X-ray source having one or more layers of thermal-conduction material (e.g., diamond) disposed in thermal communication with one or more layers of an X-ray generating material (e.g., tungsten). The thermal-conduction materials that are in thermal communication with the X-ray generating materials generally have a higher overall thermal conductivity than the X-ray generating material. The one or more thermal-conduction layers may generally be referred to as "heat-dissipating" or "heat-spreading" layers, as they are generally configured to dissipate or spread heat away from the X-ray generating materials impinged on by the electron beam to enable enhanced cooling efficiency. The interfaces between X-ray generating and thermal-conduction layers are roughened to improve adhesion between the adjacent layers. Having better thermal conduction within the source target (i.e., anode) allows the end user to operate the source target at higher powers or smaller spot sizes (i.e., higher power densities) while maintaining the source target at the same target operational temperatures. Alternatively, the source target can be maintained at lower temperatures at the same X-ray source power levels, thus increasing the operational lifetime of the source target. The former option translates into higher throughput as higher X-ray source power results in quicker measurement exposure times or improved feature detectability as smaller spot sizes results in smaller features being distinguishable. The latter option results in lower operational (variable) expenses for the end user as targets or tubes (in the case where the target is an integral part of the tube) will be replaced at a lower frequency.

One challenge for implementing such a multi-layered target is delamination of the layers, such as at the tungsten/diamond interface, due to weak adhesion and high stress levels within the layers. As discussed herein, various approaches for improving adhesion between layers and/or reducing internal stress levels in a multi-layer X-ray target are provided. In accordance with certain aspects of these approaches one or more high temperature annealing processes may be employed during fabrication that improves the mechanical stability and adhesion between the X-ray generating layer (e.g., tungsten layers) and thermal-conduction layers (e.g., diamond layers). In one implementation, a multi-layer target structure (such as a structure of five to six alternating tungsten and diamond layers on a diamond substrate) fabricated using the high temperature annealing processes described herein achieve a three-fold (i.e., 3×) increase in X-ray flux and long lifetime.

Multi-layer X-ray sources as discussed herein may be based on a stationary (i.e., non-rotating) anode structure or a rotating anode structure and may be configured for either reflection or transmission X-ray generation. As used herein, a transmission-type arrangement is one in which the X-ray beam is emitted from a surface of the source target opposite the surface that is subjected to the electron beam. Conversely, in a reflection arrangement, the angle at which X-rays leave the source target is typically acutely angled relative to the perpendicular to the source target. This effectively increases the X-ray density in the output beam, while allowing a much larger thermal spot on the source target, thereby decreasing the thermal loading of the target.

By way of an initial example, in one implementation an electron beam passes through a thermally conductive layer (e.g., a diamond layer) and is preferentially absorbed by an underlying X-ray generating (e.g., tungsten) layer. Alternatively, in other implementations an X-ray generating layer may be the first (i.e., top) layer, with a thermally-conductive layer underneath. In both instances, additional alternating layers of X-ray generating and thermally-conductive material may be provided as a stack within the X-ray source target (with either the X-ray generating or thermally-conductive layer on top), with successive alternating layers adding X-ray generation and thermal conduction capacity. As will be appreciated, the thermally conductive and X-ray generating layers do not need to be the same thickness (i.e., height) with respect to the other type of layer or with respect to other layers of the same type. That is, layers of the same type or of different types may differ in thickness from one another. The final layer on the target can be either the X-ray generating layer or the thermally-conductive layer.

With the preceding in mind, and referring to FIG. 1, components of an X-ray imaging system 10 are shown as including an X-ray source 14 that projects a beam of X-rays 16 through a subject 18 (e.g., a patient or an item undergoing security, industrial inspection, or quality control inspection). A beam-shaping component or collimator may also be provided in the system 10 to shape or limit the X-ray beam 16 so as to be suitable for the use of the system 10. It should be noted that the X-ray sources 14 disclosed herein may be used in any suitable imaging context or any other X-ray implementation. By way of example, the system 10 may be, or be part of, a fluoroscopy system, a mammography system, an angiography system, a standard radiographic imaging system, a tomosynthesis or C-arm system, a computed tomography system, and/or a radiation therapy treatment system. Further, the system 10 may not only be applicable to medical imaging contexts, but also to various inspection systems for material characterization, industrial or manufacturing quality control, luggage and/or package inspection, and so on. Accordingly, the subject 18 may be a laboratory sample, (e.g., tissue from a biopsy), a patient, luggage, cargo, manufactured parts, nuclear fuel, or other material of interest.

The subject may, for example, attenuate or refract the incident X-rays 16 and produce the projected X-ray radiation 20 that impacts a detector 22, which is coupled to a data acquisition system 24. It should be noted that the detector 22, while depicted as a single unit, may include one or more detecting units operating independently or in conjunction with one another. The detector 22 senses the projected X-rays 20 that pass through or off of the subject 18, and generates data representative of the radiation 20. The data acquisition system 24, depending on the nature of the data generated at the detector 22, converts the data to digital signals for subsequent processing. Depending on the application, each detector 22 produces an electrical signal that may represent the intensity and/or phase of each projected X-ray beam 20. While the depicted system 10 depicts the use of a detector 22, in certain implementations the produced X-rays 16 may not be used for imaging or other visualization purposes and may instead be used for other purposes, such as radiation treatment of therapy. Thus, in such contexts, no detector 22 or data acquisition subsystems may be provided.

An X-ray controller 26 may govern the operation of the X-ray source 14 and/or the data acquisition system 24. The controller 26 may provide power and timing signals to the X-ray source 14 to control the flux of the X-ray radiation 16, and to control or coordinate with the operation of other system features, such as cooling systems for the X-ray source, image analysis hardware, and so on. In embodiments where the system 10 is an imaging system, an image reconstructor 28 (e.g., hardware configured for reconstruction) may receive sampled and digitized X-ray data from the data acquisition system 24 and perform high-speed reconstruction to generate one or more images representative of different attenuation, differential refraction, or a combination thereof, of the subject 18. The images are applied as an input to a processor-based computer 30 that stores the image in a mass storage device 32.

The computer 30 also receives commands and/or scanning parameters from an operator via a console 34 that has some form of operator interface, such as a keyboard, mouse, voice activated controller, or any other suitable input apparatus. An associated display 40 allows the operator to observe images and other data from the computer 30. The computer 30 uses the operator-supplied commands and parameters to provide control signals and information to the data acquisition system 24 and the X-ray controller 26.

Figure 2:
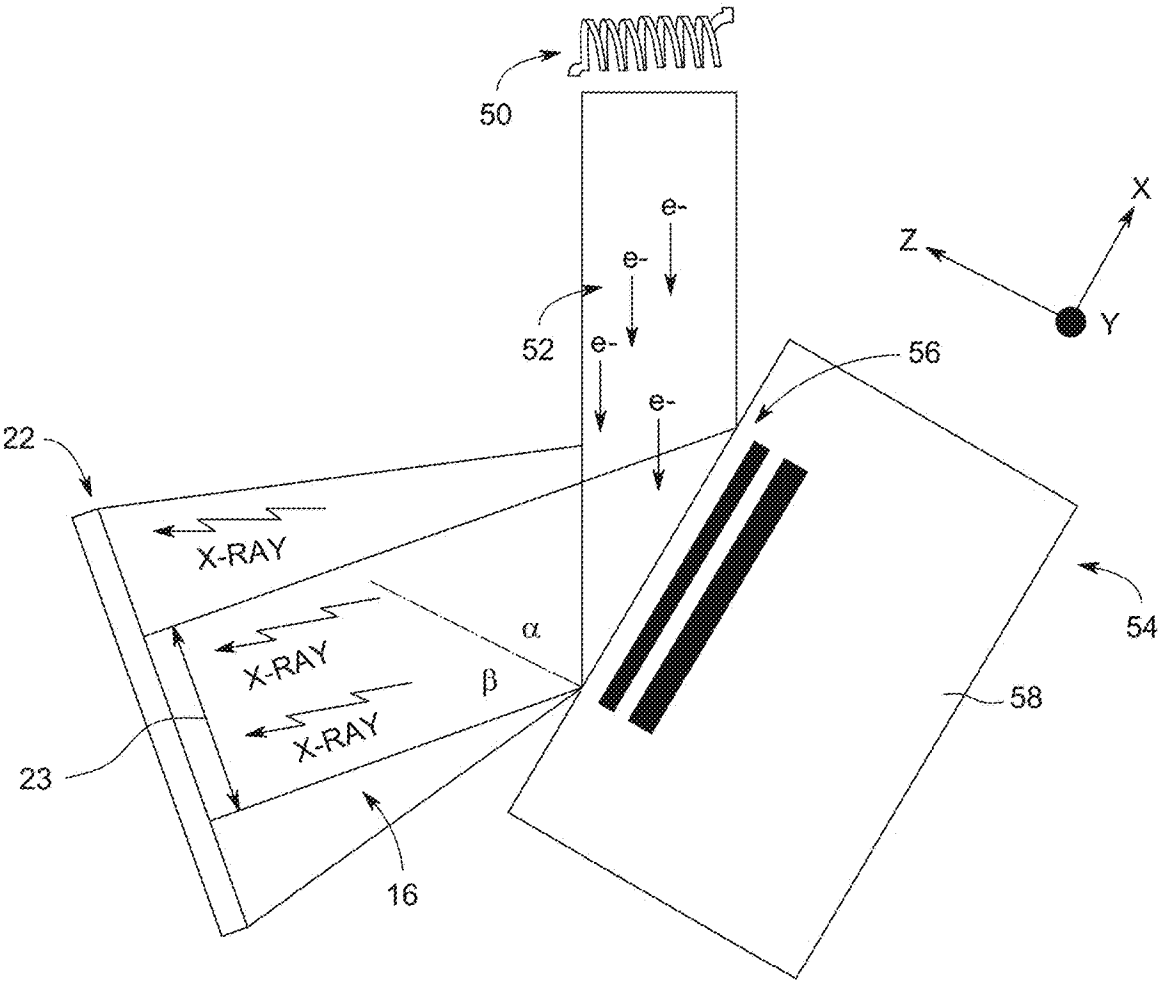
FIG. 2 depicts a generalized view of a multi-layer X-ray source and detector arrangement, in accordance with aspects of the present disclosure.

Referring now to FIG. 2, a high level view of components of an X-ray source 14, along with detector 22, are depicted. The aspects of X-ray generation shown are consistent with a reflective X-ray generation arrangement that may be consistent with either a rotating or stationary anode. In the depicted implementation, an X-ray source includes an electron beam emitter (here depicted as an emitter coil 50) that emits an electron beam 52 toward a target region of X-ray generating material 56. The X-ray generating material may be a high-Z material, such as tungsten, molybdenum, titanium-zirconium-molybdenum alloy (TZM), tungsten-rhenium alloy, copper-tungsten alloy, chromium, iron, cobalt, copper, silver, or any other material or combinations of materials capable of emitting X-rays when bombarded with electrons). The source target may also include one or more thermally-conductive materials, such as substrate 58, or thermally conductive layers or other regions surrounding and/or separating layers of the X-ray generating material 56. As used herein, a region of X-ray generating material 56 is generally described as being an X-ray generating layer of the source target, where the X-ray generating layer has some corresponding thickness, which may vary between different X-ray generating layers within a given source target.

The electron beam 52 incident on the X-ray generating material 56 generates X-rays 16 that are directed toward the detector 22 and which are incident on the detector 22, the optical spot 23 being the area of the focal spot projected onto the detector plane. The electron impact area on the X-ray generating material 56 may define a particular shape, thickness, or aspect ratio on the source target (i.e., anode 54) to achieve particular characteristics of the emitted X-rays 16. For example, the emitted X-ray beam 16 may have a particular size and shape that is related to the size and shape of the electron beam 52 when incident on the X-ray generating material 56. Accordingly, the X-ray beam 16 exits the source target 54 from an X-ray emission area that may be predicted based on the size and shape of the impact area. In the depicted example the angle between the electron beam 52 and the normal to the target is defined as $\alpha$. The angle $\beta$ is the angle between the normal of the detector and the normal to the target. Where b is the thermal focal spot size at the target region 56 and c is optical focal spot size, $b=c/\cos\beta$. Further, in this arrangement, the equivalent target angle is $90-\beta$.

As discussed herein, certain implementations employ a multi-layer source target 54 having two or more X-ray generating layers in the depth or z-dimension (i.e., two or more layers incorporating the X-ray generating material) separated by respective thermally conductive layers (including top layers and/or substrates 58). Such a multi-layer source target 54 (including the respective layers and/or intra-layer structures and features discussed herein) may be fabricated using any suitable technique, such as suitable semiconductor manufacturing techniques including vapor deposition (such as chemical vapor deposition (CVD), sputtering, atomic layer deposition), chemical plating, ion implantation, or additive or reductive manufacturing, and so on. In particular, certain fabrication approaches discussed herein may be utilized to make a multi-layer source target 54.

Referring again to FIG. 2, generally the thermally conductive layers (generally defined in the x,y plane and having depth or elevation in the z-dimension shown) are configured to conduct heat away from the X-ray generating volume during operation. That is, the thermal materials discussed herein have thermal conductivities that are higher than those exhibited by the X-ray generating material. By way of non-limiting example, a thermal-conducting layer may include carbon-based materials including but not limited to highly ordered pyrolytic graphite (HOPG), diamond, and/or metal-based materials such as beryllium oxide, silicon carbide, copper-molybdenum, copper, tungsten-copper alloy, or any combination thereof. Alloyed materials such as silver-diamond may also be used. Table 1 below provides the composition, thermal conductivity, coefficient of thermal expansion (CTE), density, and melting point of several such materials.

TABLE 1

| Material | Composition | Thermal Conductivity W/m-K | CTE ppm/K | Density g/cm$^3$ | Melting point ° C. |
|---|---|---|---|---|---|
| Diamond | Poly crystalline diamond | ≥1800 | 1.5 | 3.5 | NA* |
| Beryllium oxide | BeO | 250 | 7.5 | 2.9 | 2578 |
| CVD SiC | SiC | 250 | 2.4 | 3.2 | 2830 |
| Highly oriented pyrolytic graphite | C | 1700 | 0.5 | 2.25 | NA* |
| Cu—Mo | Cu—Mo | 400 | 7 | 9-10 | 1100 |
| Ag-Diamond | Ag-Diamond | 650 | <6 | 6-6.2 | NA* |
| OFHC | Cu | 390 | 17 | 8.9 | 1350 |

*Diamond or HOPG graphitizes at ~1,500° C., before melting, thus losing the thermal conductivity benefit. In practice, this may be the limiting factor for any atomically ordered carbon material instead of melting.

It should be noted that the different thermally-conductive layers, structures, or regions within a source target 54 may have correspondingly different thermally-conductive compositions, different thicknesses, and/or may be fabricated differently from one another, depending on the respective thermal conduction needs at a given region within the source target 54. However, even when differently composed, such regions, if formed so as to conduct heat from the X-ray generating materials, still constitute thermally-conductive layers (or regions) as used herein. For the purpose of the examples discussed herein, diamond is typically referenced as the thermally-conductive material. It should be appreciated however that such reference is merely employed by way of example and to simplify explanation, and that other suitable thermally-conductive materials, including but not limited to those listed above, may instead be used as a suitable thermally-conductive material.

In various implementations respective depth (in the z-dimension) within the source target 54 may determine the thickness of an X-ray generating layer found at that depth, such as to accommodate the electron beam incident energy expected at that depth. That is, X-ray generating layers or regions at different depths within a source target 54 may be formed so as to have different thicknesses. Similarly, depending on heat conduction requirements at a given depth, the differing thermal-conductive layers may also vary in thickness, either based upon their depth in the source target 54 or for other reasons related to optimizing heat flow and conduction.

Figure 3:
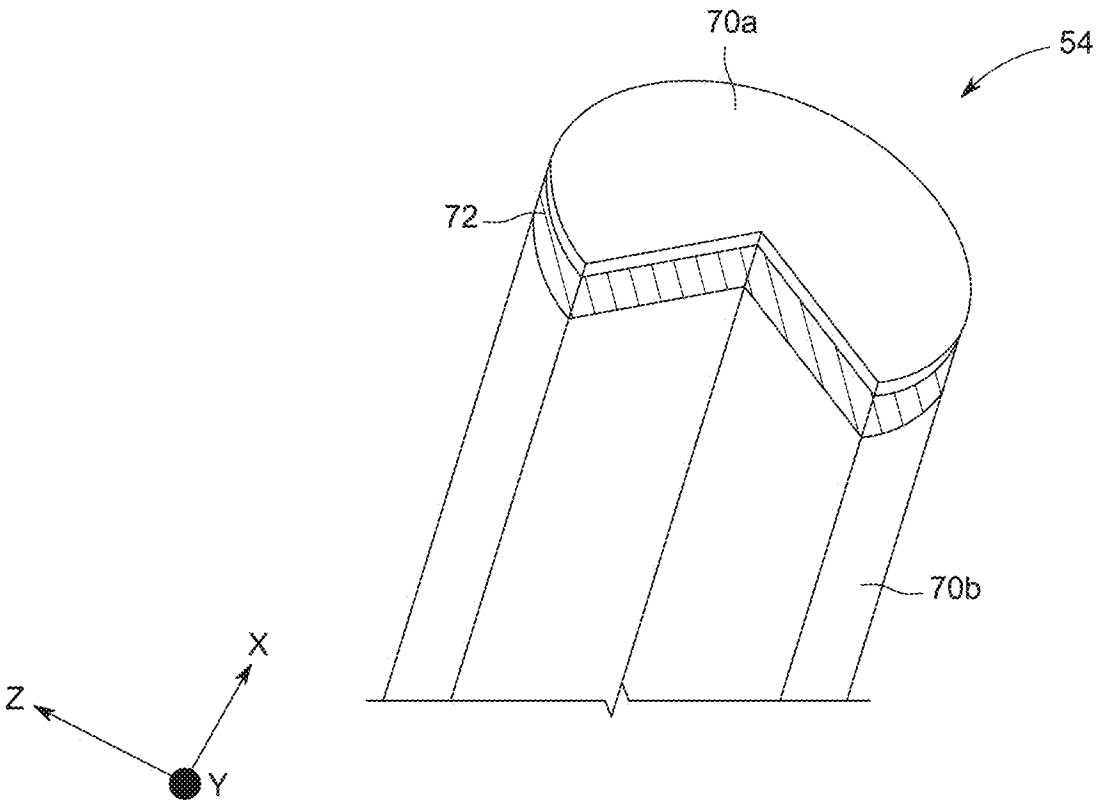
FIG. 3 depicts cut-away perspective view of a layered X-ray source, in accordance with aspects of the present disclosure.

By way of example of these concepts, FIG. 3 depicts a partial-cutaway perspective view of a stationary X-ray source target (i.e., anode) 54 having alternating layers, in the z-dimension, of: (1) a first thermally-conductive layer 70*a* (such as a thin diamond film, approximately 0 to 15 μm in thickness) on face of the source target 54 to be impacted by the electron beam 52; (2) an X-ray generating layer 72 of X-ray generating material 56 (i.e., a high-Z material, such as a tungsten layer approximately 10 to 40 μm in thickness); and (3) a second thermally-conductive layer 70*b* (such as a diamond layer or substrate approximately 1.2 mm in thickness) underlying the X-ray generating layer 72. It should be noted that, in other implementations, layer (1) is optional and may be omitted (i.e., thickness of 0), making the X-ray generating layer 72 the top layer of the source target 54. In the depicted example, which is shown to provide useful context for the examples to follow, the X-ray generating material within the X-ray generating layer 72 is continuous throughout the layer 72. Further, the example of FIG. 3 depicts a simplified example having only a single X-ray generating layer 72, though the single X-ray generating layer is part of a multi-layer source target 54 in that the X-ray generating layer 72 is sandwiched between two thermal-conduction layers 70*a* and 70*b*. As will be appreciated, in other implementations additional layers 72 of X-ray generating material and thermal conduction layers 70 may be present.

With the preceding in mind, and as noted above, one issue in fabricating and using multi-layer X-ray source targets 54 is the delamination of different layers of the source target 54.

Figure 4:
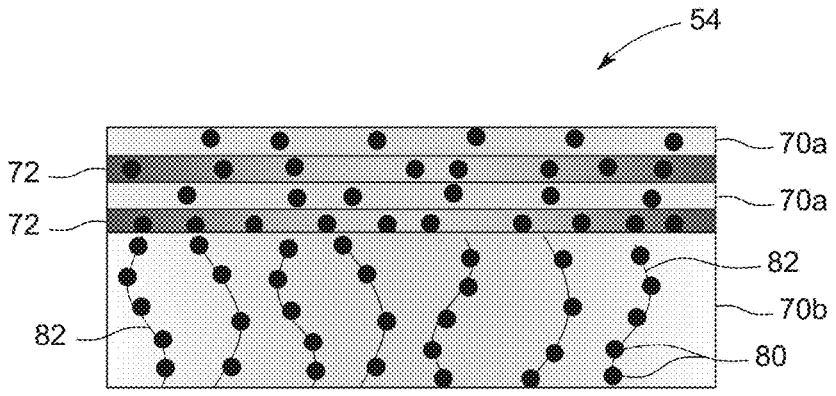
FIG. 4 depicts a generalized layer view of a multi-layer X-ray source having hydrogen present in the structure.
Figure 5:
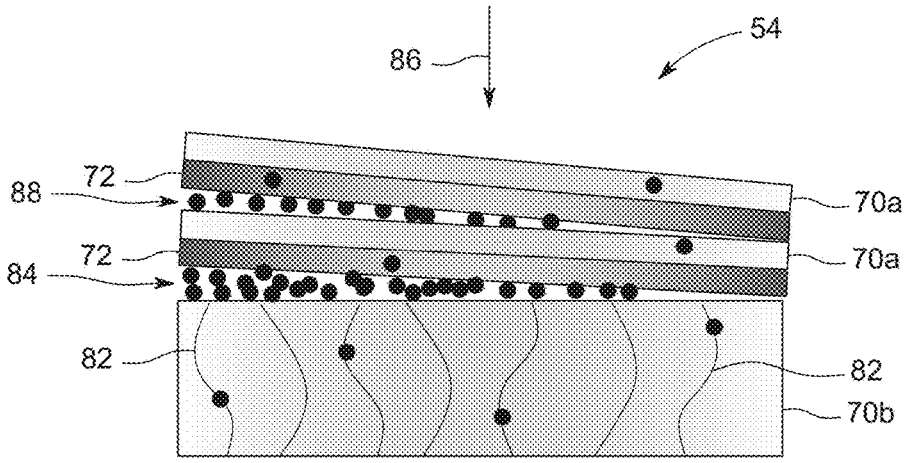
FIG. 5 depicts a generalized layer view of the multi-layer X-ray source of FIG. 4 delaminating in response to electron beam or local heating.

By way of example, FIGS. 4 and 5 jointly depict an example of hydrogen induced delamination. In this example, X-ray generating layers 72 in the form of tungsten layers are alternated with thermal-conduction layers 70*a* formed over a thermally-conductive substrate 70*b* present as the bottom-most layer. In the depicted implementation, hydrogen 80 is present throughout the diamond layers and tungsten layers and may, during operation, contribute to delamination of certain of the layers, as shown in FIG. 5.

In particular, while bulk tungsten does not exhibit hydrogen embrittlement, layered tungsten-diamond targets are different because of trapped hydrogen in chemical vapor deposition (CVD) polycrystalline diamond substrates 70*b*. Additionally, the lower density tungsten film used to alleviate stress in sputtered tungsten offers ample opportunities for hydrogen trapping to occur in tungsten during CVD diamond deposition, which may in one implementation involve the use of hydrogen plasma and ~95% of hydrogen gas, on tungsten. In addition, tungsten, when exposed to deuterium (hydrogen isotope) plasma, was observed to delaminate along grain boundaries 82 underneath the tungsten surface, and deuterium desorbed from tungsten near 550° C.

Desorption of trapped hydrogen at ~550° C. and higher temperatures has been detected in multi-layer targets 54 and significant delamination (FIG. 5) was observed when the multi-layer diamond-tungsten targets were exposed to electron beam irradiation 86 at a flux much higher than the normal level, which locally heated up the tungsten layers 72 to over 2,000° C. This delamination is believed to be attributable to the hydrogen presence or build-up in the bulk materials or at the interfaces between layers, with comparable delamination having been observed in materials such as semiconductors, carbides, and oxides, where hydrogen with a planar density of approximately $5\times10^{16}/cm^2$ is known to be sufficient to cause delamination at an interface. Thus, if the trapped hydrogen 80 in the layered diamond-tungsten target migrates to and accumulates at the interfaces between diamond and tungsten due to heating of the target 54 by the electron beam 86 irradiation, the hydrogen weakens the interface adhesion between layers, leading to delamination, as shown in FIGS. 4 and 5. Conversely, in accordance with the present approach, one or more of the X-ray generating layers and/or the thermally conductive layers have hydrogen planar density levels of less than approximately $5\times10^{16}/cm^2$ and thus reduce or eliminate delamination of the respective layers in question.

By way of example, and to provide a real-world context, a diamond substrate layer 70*b* (approximately 1,000 μm thick) may have hydrogen 80 trapped in grain boundaries 82 (having a grain size between 0.5 μm and 60 μm, such as for example approximately 40 μm) at a planar density of approximately $8\times10^{14}/cm^2$. This is represented in a simplified manner in FIG. 4. However, when heated by the electron beam 86, the hydrogen in the substrate 70*b* may diffuse to the interface 84 between substrate 70*b* and the proximate X-ray generating layer 72 such that the hydrogen 80 present in the substrate 70*b* decreases and the planar density of hydrogen 80 at the interface 84 may be approximately of $2\times10^{16}/cm^2$.

Similarly, in the film layers above the thermally-conductive substrate 70*b*, the same dynamic may be observed. For example, in the thermally-conductive (e.g., diamond) layers 70*a* (approximately 10 μm thick) hydrogen 80 may be trapped in the grain boundaries 82 (having a grain size between 0.5 μm and 60 μm, such as for example approximately 2 μm) at a planar density of approximately $8\times10^{14}/cm^2$ at non-operating temperatures (FIG. 4). In this example, the X-ray generating (e.g., tungsten) layers 72 exhibit a 3% porosity leading to $1\times10^{18}/cm^2$ hydrogen 80 in the layers 72.

With respect to the film layers, when heated during operation (FIG. 5), the hydrogen 80 diffuses to the interlayer interfaces (e.g., interface 88), leading to a hydrogen planar density between the layers 72 and 70*a* of approximately $4\times10^{15}/cm^2$. In these examples, the elevated hydrogen presence at the layer interfaces during operation cause separation of the layers and corresponding delamination.

In addition to the presence of hydrogen, lack of sufficient tungsten carbide at the tungsten-on-diamond interfaces could also result in poor adhesion due to weak chemical bonding between the diamond and tungsten. When present at the diamond-tungsten interface, tungsten carbide promotes adhesion between the layers. By way of example, in multi-layered targets 54, delamination when exposed to an electron beam 86 appears to occur more often at the tungsten-on-diamond interface where a tungsten layer 72 is formed on an underlying diamond substrate or layer 70, as shown in FIG. 5. Correspondingly, the amount of tungsten carbide at the tungsten-on-diamond interfaces is less than what is observed at the diamond-on-tungsten interfaces (i.e., where a diamond layer 70 is formed on an underlying tungsten layer 72 (FIG. 5)). This difference in the amount of tungsten carbide between the two types of interfaces is due to the different conditions used for tungsten and diamond deposition.

With the preceding in mind, the presently disclosed approach may address one or both of these issues. For example, as discussed in greater detail below, the present approach depletes hydrogen trapped in the multi-layer targets 54 and promotes tungsten carbide growth at the tungsten-on-diamond interface. Such a carbide layer promotes adhesion and reduces compressive stress in the adjacent tungsten layer. These effects may be accomplished by annealing the multi-layer target 54 in vacuum at high temperatures at one or more points in the fabrication process.

For example, in one implementation of the present approach a post-deposition annealing is conducted in vacuum at temperatures ranging from 800° C. to 1,300° C. In one example, the temperature may be increased slowly at a rate of 10° C./minute to avoid a build-up of hydrogen at the interface present at that stage of the fabrication. Similarly, the temperature may be decreased slowly at a rate of 10° C./minute to avoid a quenching effect which compromises the mechanical integrity of the layer stack. A long annealing time, such as 20 hours, is preferred as desorption of trapped hydrogen and growth of interfacial carbide layer are both kinetically limited.

Figure 6:
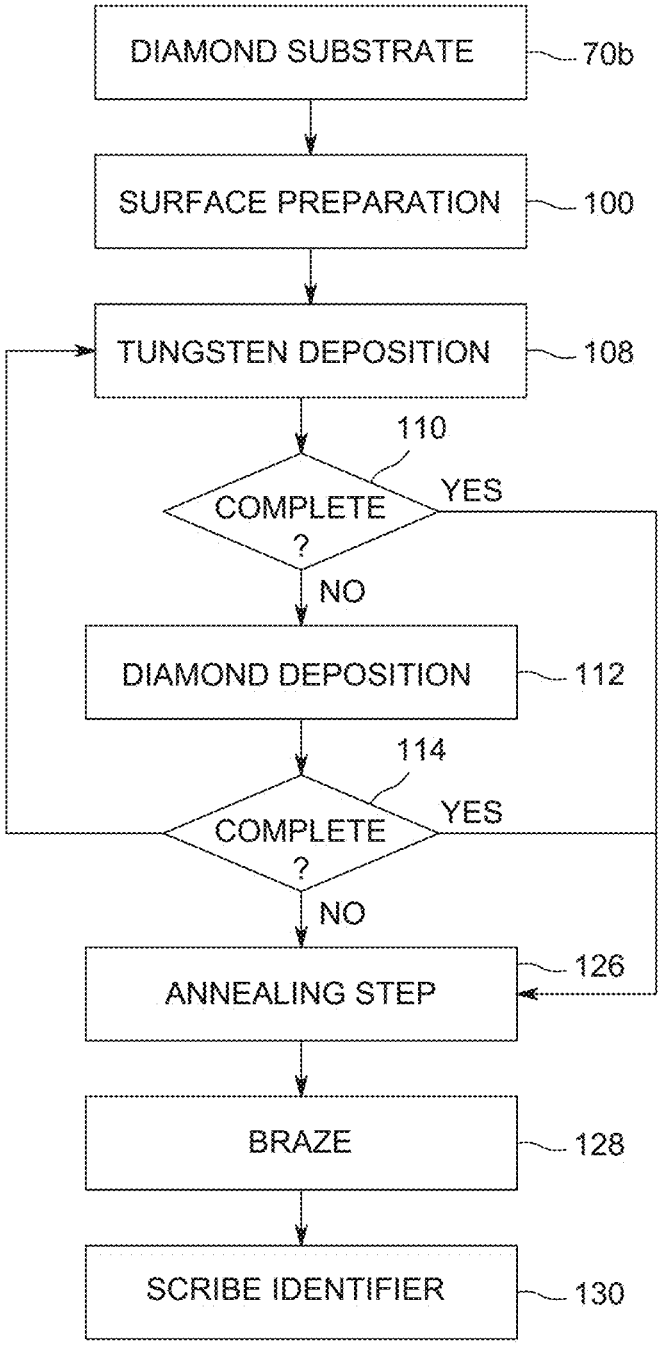
FIG. 6 depicts a process flow depicting example steps in a multi-layer source target fabrication, in accordance with aspects of the present disclosure.

With the preceding discussion in mind, FIG. 6 depicts an example of a process flow suitable for fabricating a tungsten and diamond multi-layer source target 54 that is resistant to delamination of the layers. In particular, the depicted process flow provides for the fabrication of a multi-layer source target having one or both of depleted hydrogen content in the produced target structure and/or tungsten carbide interlayers formed at the tungsten-on-diamond interface. It should be appreciated that the steps and operations described with respect to FIG. 6 describe only one implementation of a suitable layer deposition process so as to provide a useful example and practical context. Thus, unless indicated otherwise, certain of the described steps may be omitted (i.e., are optional) or may be performed under different conditions or using different techniques (e.g., deposition techniques) while still falling within the scope of the present disclosure. Indeed, while certain steps may be called out as optional, other steps may also be optional or unnecessary in a given implementation or context, such as where quality standards, product reliability, or costs factors are countervailing considerations. Similarly, it should be understood that various steps (such as surface preparation steps, surface cleaning steps, and so forth), may be performed in an implementation, though not discussed in depth below. That is, the present discussion is intended to primarily focus on those steps most relevant to the formation of comparable tungsten carbide layers and/or the depletion of trapped hydrogen from fabricated multi-layer X-ray source. Thus, it should be understood that the following example is a non-limiting example, provided merely for illustrative purposes and not as an explicitly limiting guideline.

In the depicted example, a diamond substrate 70*b* is initially provided and this substrate 70*b* undergoes a substrate preparation process 100 to prepare the surface of the substrate 70*b* for further processing.

A layer of tungsten is deposited (step 108) on the diamond substrate 70*b* at either room temperature or elevated temperatures by physical vapor deposition or other suitable film deposition techniques. Thus, at the end of step 108, a diamond substrate 70*b* is present on which a layer of tungsten 72 has been deposited.

In the depicted flow, a determination is made (block 110) as to whether an additional diamond layer is to be added to the multi-layer source target being fabricated. If, at decision block 110, it is determined that more layers are to be added, the process may proceed to adding a diamond layer 70*a* at diamond deposition step 112. In one implementation, a CVD diamond deposition involves exposing the surface of the topmost tungsten layer 72 to a mixture of gases until the diamond film reaches a thickness of approximately 8 μm to 15 μm. The desired diamond thickness may be based on the expected incident electron beam energy and beam spot size. As noted above, though tungsten carbide may form at the layer interface of the tungsten-on-diamond deposition and the diamond-on-tungsten deposition, considerably more tungsten carbide is formed in the diamond-on-tungsten deposition (step 112) than in the tungsten-on-diamond deposition (step 110).

As after the tungsten deposition 108, a determination is made (block 114) after diamond layer deposition step 112 as to whether an additional tungsten layer 72 is to be added to the multi-layer source target being fabricated. If an additional tungsten layer 72 is to be added, the process may return to step 108 and the process repeated until no additional layers are to be added.

With this in mind, if at either decision blocks 110 or 112 it is determined that no additional layers are to be added, the fabricated multi-layer source is subjected to an annealing step 126 as discussed herein. In one example, the annealing step 126 is conducted in vacuum or inert gas environment at temperatures ranging from 800° C. to 1,300° C. In one such approach, the temperature may be increased over time, such as at a rate of 10° C./minute. Such rates of increase may be linear or non-linear (e.g., curvi-linear, quadratic, exponential, and so forth) in nature. In one aspect, the rate of increase is less than 20° C./minute so as to avoid the sudden build-up of hydrogen at the interfaces between deposited layers. Likewise, at the end of the annealing step 126, the temperature may be decreased slowly (e.g., at a rate of 5° C./minute to 15° C./minute) when the temperature is above 500° C. to avoid a quenching effect that might compromise the mechanical integrity of the layer stack. In certain implementations, the annealing step is performed for a time period between 10 hours and 20 hours, with longer time intervals facilitating the desorption of trapped hydrogen and the growth of interfacial carbide layers, which are both kinetically limited. It should be appreciated that though a single annealing step 126 is depicted, which occurs after all layers have been deposited, in practice additional annealing steps 126 may be performed, such as after deposition of all layers, after deposition of all tungsten layers 72, after deposition of all diamond layers 70, or based upon some other defined schedule. Such additional annealing steps may lengthen the fabrication process, but may contribute to additional stability and structural integrity of the resulting multi-layer target structure.

As part of the X-ray source target fabrication, the multi-layer target assembly fabricated in accordance with these steps may be brazed (step 128) to a copper target and the excess brazing material removed. An identifier may be laser scribed (step 130) on the copper target as part of this fabrication process.

Figure 7:
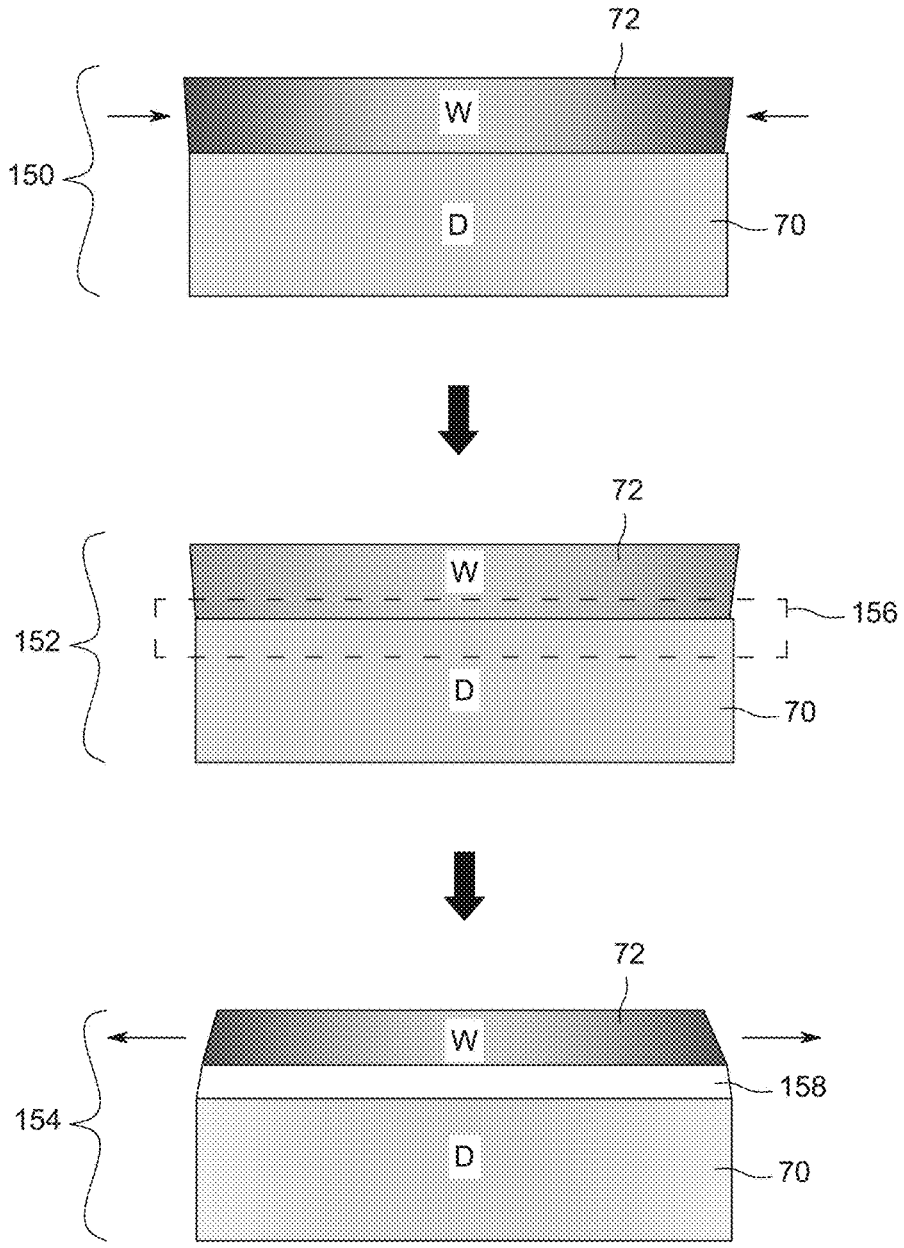
FIG. 7 depicts a process flow showing a layer stack of a multi-layer target in the process before, during, and after an annealing step, in accordance with aspects of the present disclosure.

Turning to FIG. 7 a schematic view of layer relationships before and after the annealing step 126 is depicted. In this example, the topmost view 150 corresponds to a view of two layers, a thermally-conductive layer 70 on which an X-ray generating layer 72 has been deposited. As deposited the X-ray generating layer 72 is subject to compressive forces after completion of the deposition, which may subject the interface between the layers with stresses that might allow delamination.

In the middle view 152, the two layers 70, 72 are shown in the midst of an annealing step 126. In this example, a layer 158 of tungsten carbide is formed between the tungsten layer 72 and diamond layer 70 at the interface contained within dashed line 156. As noted above, the annealing step 126 depletes hydrogen (and other gases) trapped in the layer stack.

The tungsten carbide layer 158 is shown more clearly in bottommost view 154 depicting the layers after completion of the annealing step. As noted above, the tungsten carbide layer 158 promotes adhesion between layers 70, 72 and, in addition, one effect of the annealing step 126 is to reduce compressive stress in the tungsten layer 72 as tungsten carbide formation leads to a volume reduction, further improving structural integrity of the stack.

Technical effects of the invention include fabrication of a multi-layer X-ray source having decreased hydrogen within the stack and/or tungsten carbide inter-layers between the primary layers of X-ray generating and thermally-conductive materials. The resulting multi-layer target structures allow increased X-ray production, which may facilitate faster scan times for inspection or examination procedures. Further, increased X-ray production may be associated with an ability to maintain dose for shorter pulses in the case where object motion causes image blur. Similarly, smaller spot size may be accommodated and may allow higher resolution or smaller feature detectability. As a result, the technology increases the throughput and resolution of x-ray inspection, and reduces the cost.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray source, comprising:

an emitter configured to emit an electron beam; and a target configured to generate X-rays when impacted by the electron beam, the target comprising:

at least one X-ray generating layer comprising X-ray generating material, wherein planar density hydrogen held within some or all of the X-ray generating layers is less than $5\times10^{16}/cm^2$; and at least one thermally-conductive layer in thermal communication with each X-ray generating layer, wherein each thermally conductive layer or substrate comprises grain boundaries in which hydrogen is held, and wherein the planar density hydrogen held within some or all of the thermally conductive layers is less than $5\times10^{16}/cm^2$.

2. The X-ray source of claim 1, wherein the X-ray generating material comprises one or more of tungsten, molybdenum, titanium-zirconium-molybdenum alloy (TZM), tungsten-rhenium alloy, copper-tungsten alloy, chromium, iron, cobalt, copper, silver.

3. The X-ray source of claim 1, wherein the thermally-conductive layers comprise one or more of highly ordered pyrolytic graphite (HOPG), diamond, beryllium oxide, silicon carbide, copper-molybdenum, copper, tungsten-copper alloy, or silver-diamond.

4. The X-ray source of claim 1, further comprising one or more carbide layers disposed between each X-ray generating layer and thermally-conductive layer.

5. The X-ray source of claim 1, wherein the at least one X-ray generating layer comprises tungsten and the at least one thermally-conductive layer comprises diamond.

6. The X-ray source of claim 1, wherein one thermally conductive layer comprises a thermally conductive substrate on which the remaining layers are deposited.

7. The X-ray source of claim 1, wherein the grain size of the grain boundaries is between approximately 0.5 μm to approximately 60 μm.

8. An X-ray source, comprising:

an emitter configured to emit an electron beam; and a target configured to generate X-rays when impacted by the electron beam, the target comprising:

at least two X-ray generating layers comprising X-ray generating material;

at least two thermally-conductive layers in thermal communication with each adjacent X-ray generating layer, wherein the X-ray generating layers are alternated with the thermally-conductive layers; and a carbide layer positioned between each X-ray generating layer and adjacent thermally-conductive layer.

9. The X-ray source of claim 8, wherein the X-ray generating material comprises tungsten, the thermally-conductive layer comprises diamond, and the carbide layer comprises tungsten carbide.

10. The X-ray source of claim 8, wherein the X-ray generating material comprises one or more of tungsten, molybdenum, titanium-zirconium-molybdenum alloy (TZM), tungsten-rhenium alloy, copper-tungsten alloy, chromium, iron, cobalt, copper, silver.

11. The X-ray source of claim 8, wherein the thermally-conductive layers comprise one or more of highly ordered pyrolytic graphite (HOPG), diamond, beryllium oxide, silicon carbide, copper-molybdenum, copper, tungsten-copper alloy, or silver-diamond.

12. The X-ray source of claim 8, wherein one thermally conductive layer comprises a thermally conductive substrate on which the remaining layers are deposited.

13. A method for fabricating an X-ray source target, comprising:

depositing, in alternation, an X-ray generating layer comprising an X-ray generating material and a thermally-conductive layer comprising a thermally-conductive material on a thermally-conductive substrate to form a multi-layer target structure of at least two X-ray generating layers and at least two thermally-conductive layers;

performing an annealing operation on the multi-layer target structure, wherein the annealing operation results in carbide layers formed between each layer of X-ray generating material and thermally-conductive material.

14. The method of claim 13, wherein the X-ray generating material is tungsten, the thermally-conductive material is diamond, and the carbide layers are tungsten carbide layers.

15. The method of claim 13, wherein the deposition of X-ray generating material on thermally-conductive material is carried out under different conditions than the deposition of thermally-conductive material on X-ray generating material.

16. The method of claim 13, wherein the act of depositing ends with a layer of X-ray generating material on the top of the multi-layer target structure.

17. The method of claim 13, wherein the act of depositing ends with a layer of thermally-conductive material on the top of the multi-layer target structure.

18. The method of claim 13, wherein one or more additional annealing operations are performed between deposition steps of the act of depositing X-ray generating material and thermally-conductive material.

19. The method of claim 13, wherein the annealing step is performed in a vacuum at between about 800° C. to about 1300° C.

20. The method of claim 13, wherein the carbide layer resulting from the annealing operation promotes adhesion and reduces compressive stress in the adjacent X-ray generating material.

* * * * *